US007691759B2

(12) United States Patent
Perry et al.

(10) Patent No.: US 7,691,759 B2
(45) Date of Patent: Apr. 6, 2010

(54) BARREL ASSEMBLY WITH REMOVABLE BARREL INSERT FOR PNEUMATIC PAINTBALL GUN

(75) Inventors: Roderick A. Perry, Greenburg, PA (US); William Gardner, Jr., Lingonier Township, PA (US)

(73) Assignee: Smart Parts, Inc., Loyalhanna, PA (US)

( * ) Notice: Subject to any disclaimer, the term of this patent is extended or adjusted under 35 U.S.C. 154(b) by 497 days.

(21) Appl. No.: 10/944,141

(22) Filed: Sep. 16, 2004

(65) Prior Publication Data

US 2005/0091901 A1 May 5, 2005

Related U.S. Application Data

(60) Continuation of application No. 10/274,075, filed on Oct. 17, 2002, now Pat. No. 6,823,857, which is a division of application No. 09/747,718, filed on Dec. 22, 2000, now Pat. No. 6,494,195.

(60) Provisional application No. 60/203,250, filed on May 8, 2000.

(51) Int. Cl.
*F41A 21/10* (2006.01)

(52) U.S. Cl. ..... 442/77; 124/84

(58) Field of Classification Search ..... 124/84, 124/73, 77, 83; 42/79, 77
See application file for complete search history.

(56) References Cited

U.S. PATENT DOCUMENTS 329,793 A * 11/1885 Wheeler ..... 42/77
985,308 A 2/1911 Van Voorhis
1,217,347 A * 2/1917 Rosengarten ..... 42/77
2,003,290 A 6/1935 Gurney et al. ..... 42/105

(Continued)

FOREIGN PATENT DOCUMENTS

DE 2602455 8/1977

(Continued)

OTHER PUBLICATIONS

PCRI Magazine, vol. 8, Issue 69, Nov. 1998, pp. 11-12.

*Primary Examiner*—Troy Chambers
(74) *Attorney, Agent, or Firm*—Simple IP Law, P.C.; Craig R. Rogers

(57) ABSTRACT

A barrel assembly for a pneumatic paintball gun includes a barrel body and a barrel insert. The barrel body has a breech end, a muzzle end, and a barrel bore extending longitudinally through the barrel body from the breech end to the muzzle end. The barrel insert has a breech end, a distal end, and an insert bore, and is configured to be removably housed within a breech portion of the bore of the barrel body. The breech end of the barrel body is configured to attach to a breech end of the paintball gun. The barrel insert collaborates with the barrel body to provide a firing bore for the barrel assembly which guides a paintball fired from the breech end of the gun through the barrel and out the muzzle end of the barrel body. The barrel insert can be constructed having a thin, flexible wall so as to permit lateral deformation of the barrel insert. This lateral flexibility enables the insert to dynamically adapt to the shape and diameter of the paintball, thereby increasing the efficiency of the energy transfer from the compressed gas to the paintball.

19 Claims, 6 Drawing Sheets

U.S. PATENT DOCUMENTS

| | | | | | |
|---|---|---|---|---|---|
| 2,117,935 | A | | 5/1938 | Benjamin et al. | 124/15 |
| 2,416,712 | A | * | 3/1947 | Parker | 42/76.01 |
| 2,734,311 | A | * | 2/1956 | Christopher | 446/473 |
| 3,407,526 | A | * | 10/1968 | Freed | 42/59 |
| 3,805,434 | A | * | 4/1974 | Sudano | 42/77 |
| 3,949,731 | A | | 4/1976 | Caso | 124/27 |
| 3,989,027 | A | | 11/1976 | Kahelin | 124/58 |
| 4,437,249 | A | | 3/1984 | Brown et al. | 42/51 |
| 4,546,564 | A | * | 10/1985 | A'Costa | 42/76.01 |
| 4,644,930 | A | | 2/1987 | Mainhardt | 124/58 |
| 4,660,312 | A | | 4/1987 | A'Costa | 42/76.01 |
| 4,735,009 | A | | 4/1988 | Jett, Jr. | 42/77 |
| 4,819,609 | A | | 4/1989 | Tippmann | 124/72 |
| 4,833,810 | A | | 5/1989 | Domian | 42/59 |
| 4,936,170 | A | | 6/1990 | Zumeta | 81/180.1 |
| 4,936,282 | A | | 6/1990 | Dobbins et al. | 124/74 |
| 4,982,627 | A | | 1/1991 | Johnson | 81/121.1 |
| 4,989,359 | A | | 2/1991 | Kinkner et al. | 42/77 |
| 5,228,427 | A | | 7/1993 | Gardner, Jr. | 124/71 |
| 5,349,939 | A | | 9/1994 | Perrone | 124/76 |
| 5,363,769 | A | | 11/1994 | Bellak et al. | 102/446 |
| D353,853 | S | | 12/1994 | Albritton | D21/572 |
| 5,448,848 | A | | 9/1995 | Moller | 42/77 |
| 5,556,319 | A | | 9/1996 | Watkins | 446/475 |
| 5,557,871 | A | * | 9/1996 | LaLonde | 42/95 |
| 5,613,482 | A | * | 3/1997 | Thai et al. | 124/16 |
| 5,630,406 | A | | 5/1997 | Dumont | 124/56 |
| 5,769,161 | A | * | 6/1998 | Borden | 166/72 |
| 5,823,173 | A | | 10/1998 | Slonaker et al. | |
| 5,845,629 | A | * | 12/1998 | Ratliff | 124/56 |
| 6,082,227 | A | | 7/2000 | Vogel | 81/119 |
| 6,273,080 | B1 | | 8/2001 | Sullivan, Jr. | 124/84 |
| 6,286,496 | B1 | | 9/2001 | Bednar | |
| 6,295,752 | B1 | | 10/2001 | Havlock | 42/76.01 |
| 6,318,230 | B1 | | 11/2001 | Bamber | |
| 2002/0078616 | A1 | | 6/2002 | Perry et al. | |

FOREIGN PATENT DOCUMENTS

| | | |
|---|---|---|
| GB | 1033880 | 6/1966 |

* cited by examiner

BARREL ASSEMBLY WITH REMOVABLE BARREL INSERT FOR PNEUMATIC PAINTBALL GUN

This application is continuation of U.S. patent application Ser. No. 10/274,075, filed Oct. 17, 2002 now U.S. Pat. No. 6,823,857, which is a Divisional of U.S. patent application Ser. No. 09/747,718, filed Dec. 22, 2000 now U.S. Pat. No. 6,494,195, which claims priority from Provisional Patent Application Ser. No. 60/203,250, filed May 8, 2000.

BACKGROUND OF THE INVENTION

This invention relates generally to barrels for paintball guns, and more specifically to a barrel assembly for a pneumatic paintball gun.

Pneumatic paintball guns are typically used for individual or team recreational sports games, such as "survival" or "capture the flag." Paintball competitions are organized on levels from local competition to international matches, and paintball outings are often set up for professional competitions or executive training and relaxation, as well as police/military training maneuvers. Products for the recreational paintball gun user and products for police and military training have diverged, however, and have evolved based on the differing needs of the applications. For example, police and military units prefer paintball guns and accessories which simulate performance of hand guns over close ranges. In contrast, recreational paintball users generally prefer paintball guns and accessories which permit rapid fire over longer distances with large ammunition reserves.

In a typical paintball competition, each player carries a paintball gun and a large supply of paintballs. Regardless of the type of game being played, when a player is marked by a paintball, he is removed from play. Generally, the last player or team remaining in play (or the team first able to accomplish the assigned task—e.g., flag capture—without being marked) wins the competition. It is therefore desirable to have a pneumatic paintball gun and barrel that provides accurate and consistent aiming.

Unlike conventional guns which fire bullets using a small explosive charge contained within a bullet jacket, pneumatic paintball guns use external compressed gas sources (such as carbon dioxide, nitrogen, or compressed air) to provide propulsion for a projectile. Pneumatic paintball guns launch paint-filled projectiles, called paintballs, by controlling the release of the compressed gas from the gun. The paintball is propelled from the breech region of the gun into and through the bore of the barrel and emerges from the muzzle to mark a remote target. Pneumatic paintball guns fire paintballs at a muzzle velocity of approximately 300 feet per second (fps).

U.S. Pat. Nos. 4,656,092; 5,353,712; and 5,823,173 describe fluid-filled projectiles variously denominated as shooting capsules, marking pellets, and paintballs (hereinafter generically referred to as a "paintballs"). Paintballs are generally made of a frangible, spherical, gelatin shell filled with non-toxic, water-soluble, and biodegradable "paint." The paint is typically a natural oil (such as a mineral, vegetable, or fish-based oil) mixed with starch, water, and an artificial, non-toxic dye. When a competitor is hit with a paintball, the gelatin shell ruptures and the paint is released onto and marks the target, thereby providing evidence of the hit without substantially injuring the competitor.

Although the shell of a paintball is ideally a spheroid having a diameter of 0.68 inches, in practice, paintballs are never truly spherical and have varying diameters. Real paintballs have seams and are frequently oblong in shape. Further, due to variations among manufacturers and other factors, such as ambient weather conditions, their diameters may vary from between 0.65 to 0.70 inches.

Variations in paintball diameter and shape are due at least in part to the fact that the frangible shell must possess contradictory characteristics. It must not only provide sufficient structural integrity to withstand firing from the pneumatic gun without breaking, it must, at the same time, be sufficiently fragile to permit fracture upon impact with the target, even when the target absorbs some of the energy of the impact. Increased shell strength, while decreasing the risk of paintball breakage in the gun, decreases the likelihood of marking the target and also increases the risk of personal injury to paintball participants. Temperature changes also affect the structural character of the shell. Higher temperatures increase the flexibility of the shell, while lower temperatures cause it to become more brittle.

Paintball shells are therefore constructed of materials and thicknesses sufficiently flexible, resilient, and yet frangible, so as to accommodate these dual requirements in varying conditions. As a result, paintballs exhibit significant shape deformations in response to physical stress, such as that caused by the impact of the compressed gases during launching.

Additionally, the fluid and air within the paintball are prone to expansion and contraction in response to changes in ambient temperature and humidity. This paintball "breathing," also affects the diameter of the paintball. As described ill U.S. Pat. No. 5,228,427 (Gardner, Jr.), and U.S. Pat. No. 5,823,173 (Slonaker et al.), the clearance between the paintball and the inner walls of the barrel affects both distance and accuracy. A barrel that is too loose will allow gas to escape around the paintball and will therefore be inefficient in imparting energy from the compressed gas to the paintball. On the other hand, a barrel that is too tight around a paintball will create drag on the paintball, thereby slowing it down and preventing it from reaching its desired velocity. Furthermore, excessive drag or gripping between the paintball and the barrel bore increases the probability of shell rupture within the barrel.

In short, paintballs must be constructed so as to ensure effective discharge of their contents upon impact with the desired target. This goal cannot be achieved, however, if the paintball is manufactured with such strength and rigidity as to maintain a constant diameter in the face of ambient environmental factors and launching stress. It is desirable, therefore, to provide a barrel system for a paintball gun in which the barrel bore size can be customized in response to variations in paintball diameter caused by the particular weather conditions confronting the user or due to variations among paintball manufacturers.

According to the prior art, interchanging gun barrels in response to ambient temperature and weather conditions has been accomplished through the exchange of an entire barrel for another entire barrel of a different bore size or shape. This prior art method is unattractive to the Paintball enthusiast for several reasons. Paintball unbarrels are fairly long, typically spanning between ten to eighteen inches.

These barrels are also generally made of metal and weigh several ounces each. Their length and weight makes it awkward and uncomfortable to carry multiple barrels, especially during a paintball competition when the participant must perform athletic movements, such as crouching, leaping, crawling, or rolling on the ground. Furthermore, because stealth is often important in paintball matches, carrying multiple barrels may produce undesirable noise by contacting other hard objects in the users pack. Lastly, most barrels are fairly expensive—running anywhere between fifty dollars to well over an hundred dollars—making acquiring several barrels a costly proposition, especially for the recreational player.

In Gardner, Jr., it was disclosed that a choke having a cross-sectional area only slightly larger than that of the paintball could be provided to course a very short distance down the barrel from its breech end. According to Gardner, Jr., this tight choke was found to concentrate the propelling gas behind the paintball and to center the ball in its initial passage. Gardner, Jr., however, teaches that the length of these chokes should be kept very short to prevent undesired drag on the paintball. Choke lengths ranging from 0.5 inch, deemed preferable, to less than 3 inches were discussed, while chokes of longer than four inches were strongly discouraged as likely to impair flight distance too greatly to be effective. Gardner, Jr. also teaches that several chokes of varying internal diameters can be employed to accommodate variations in paintball diameters.

Similarly, one paintball equipment manufacturer provides a set of short chokes of various cross-sectional bore areas to interchangeably accommodate varying paintball diameters. These chokes thread into a breech end of a paintball gun and the barrel is then threaded onto the choke. Although these interchangeable chokes provide a tight-fitting entrance for paintballs of various diameters to enter into the barrel, they are relatively short and extend only slightly into the breech end of the barrel. They therefore fail to sufficiently stabilize the paintball trajectory and do not provide efficient transfer of energy from the compressed gas to the paintball.

A need exists for a convenient system for changing barrel bore sizes by which the user can react to permutations in paintball parameters caused by ambient weather conditions or inconsistencies in the manufacturing of paintballs.

SUMMARY OF THE INVENTION

An object of the present invention is to provide a barrel assembly that permits convenient adaptation of bore size to maximize performance with paintballs of different cross-sectional dimensions. It is a further object of the present invention to provide a barrel assembly that permits rapid interchangeability of barrel bore diameters.

Another object of the present invention is to permit rapid interchange of barrel bore diameters in the field, so that the user can respond to changing conditions or correct inappropriate initial settings during play without substantial burden or interruption.

A still further object of the present invention is to improve ease of gun use as well as paintball distance and accuracy.

An additional object of the invention is to minimize the size and expense of parts that must be interchanged to coordinate the barrel bore size with the diameter of the paintball.

A still further object of the present invention is to provide a barrel that dynamically adapts to the size and shape of a paintball to provide a tight fit between the barrel and the paint ball to permit more efficient use of compressed gas and to increase the range and accuracy of the paintball gun.

A barrel assembly for a pneumatic paintball gun includes a barrel body and a barrel insert. A plurality of barrel inserts each having a different internal bore diameter can be provided. Each barrel insert is removably securable within a breech portion of the barrel body to receive a paintball from the paintball gun during firing. The barrel insert is preferably constructed such that it dynamically adapts to the shape of the paintball during firing. In this manner, the barrel assembly with removable barrel insert provides enhanced distance and accuracy and is adaptable, both manually and dynamically, to variations in the diameter and shape of a paintball being fired therethrough.

According to a preferred embodiment, the barrel body is a cylindrical tube having a breech end, for attaching to a breech end of a paintball gun, and a muzzle end, A barrel bore extends through the barrel body from the breech end to the muzzle end. The barrel insert is also a cylindrical tube and has a breech end, a distal end, and an insert bore extending through the barrel insert from the breech end to the distal end. The barrel insert is removably housed within a breech portion of the barrel bore. The insert bore collaborates with a muzzle portion of the barrel bore to provide a path that guides a paintball fired by the gun through the barrel. The barrel insert preferably extends through at least half of a back portion of the barrel and most preferably extends through the entire barrel back, or breech portion of the barrel bore.

The barrel insert preferably has a wall thickness small enough to provide the barrel insert with lateral flexibility. Lateral flexibility permits the cross-sectional shape of the barrel insert to adapt to more closely and dynamically match to the size and shape of the paintball fired through it. The barrel insert can, for example, be constructed of a metal, such as aluminum, and have a wall thickness of about 0.025 inches. The barrel insert is also preferably removably retained within the barrel body in a manner that permits the walls of the barrel insert to flex in response to the passage of a paintball or column of decompressing gas therethrough. O-rings located within grooves in the barrel bore can be used for this purpose.

The barrel assembly is removably attached to the breech end of the gun. When tie barrel assembly is removed from the paintball gun, the barrel insert is readily accessible, facilitating easy removal and replacement. Multiple barrel inserts are preferably provided, each having a different internal bore diameter. Once the barrel insert is removed from the barrel bore, another barrel insert of an appropriate insert bore diameter according to the size of the paintballs being used can be selected by a user and inserted into the barrel bore. The barrel assembly is then reaffixed to the paintball gun and the gun barrel is thereby provided with a different internal bore size that accommodates the needs of the user.

Further details and advantages of the present invention will be apparent from the following detailed description, in conjunction with the accompanying drawings. The drawings are offered by way of illustration only and are not necessarily to scale and should not be interpreted to limit the scope of the present invention in any way.

BRIEF DESCRIPTION OF THE DRAWINGS

The foregoing objects and advantages of the present invention will become more readily apparent from the following detailed description of the preferred embodiments made with reference to the attached figures, in which.

DETAILED DESCRIPTION

Figure 1:
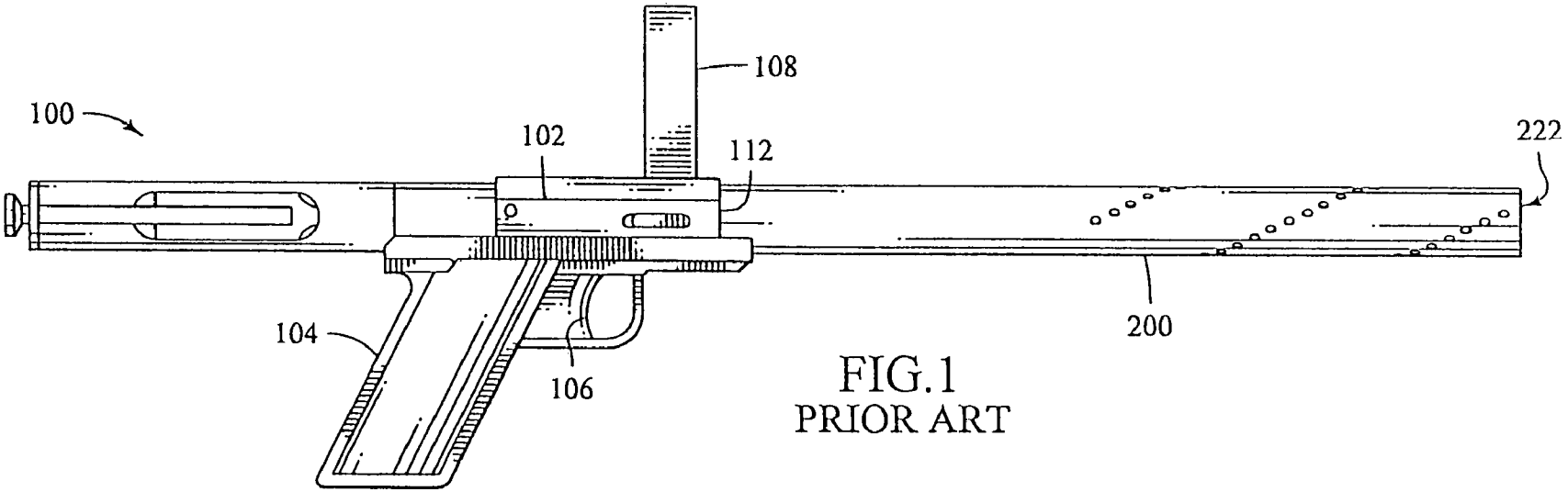
FIG.1 PRIOR ART
FIG. 1 is a side view of a pneumatic paintball gun having a barrel constructed according to the prior art.
Figure 2:
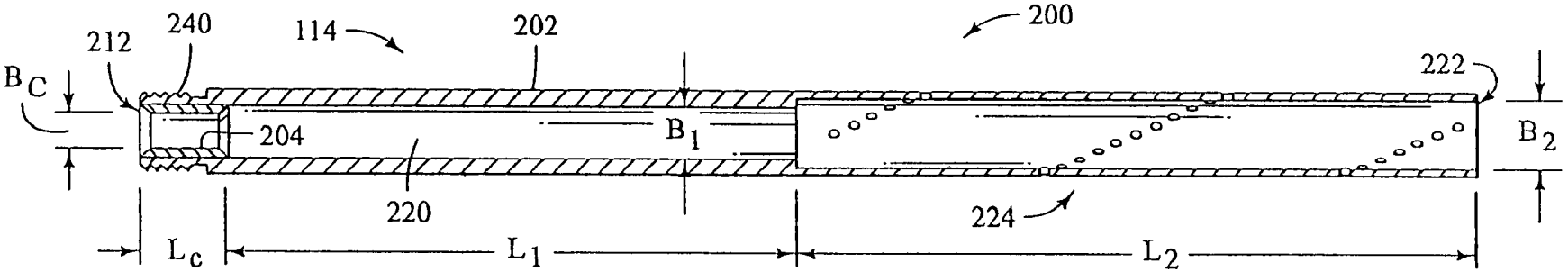
FIG.2 PRIOR ART
FIG. 2 is a cross-sectional side view of the barrel of FIG. 1.

FIGS. 1 and 2 show a pneumatic paintball gun 100 and barrel 200 according to the prior art, as shown and described in Gardner, Jr. Referring to FIGS. 1 and 2, a pneumatic paintball gun 100 includes a gun body 102 having a handle or grip 104, a trigger 106, and a feeder tube 108 for loading paintballs into a firing chamber or internal magazine (not shown). A barrel 200 is essentially a cylindrical tube having a breech end 212 and a muzzle end 222. A barrel bore 220 extends through the barrel 200 from the breech end 212 to the muzzle end 222. The breech end 212 of the barrel 200 is attached to the breech 112 of the paintball gun 100 to communicate with the firing chamber of the paintball gun 100. The muzzle end 222 is positioned away from the gun body 102 and provides an exit port through which the paintball is expelled towards a target.

Prior attempts to increase the accuracy and range of paintball guns have resulted in various barrel improvements. The barrel 200 shown in FIG. 2, for instance, provides three stages for transitioning the paintball through the gun barrel 200 and directing it toward a target. A short choke 204 is positioned within the barrel bore 220 adjacent the breech end 212 of the barrier 200 and provides a first stage or choke bore having a length $L_C$ and a bore diameter $B_C$. The first stage receives the paintball from the paintball gun and centers the ball in its initial passage.

The paintball exits the first stage into a second stage having a bore diameter $B_1$, larger than the bore diameter $B_C$ of the choke. The second stage consists of a section of the barrel bore that extends internally along a longitudinal axis of the barrel 200 from the first stage toward the muzzle end 222 for a length $L_1$. The paintball exits the second stage into a third stage having a length $L_2$ and a bore diameter $B_2$. The bore diameter $B_2$ of the third stage is larger than the first bore diameter $B_1$ and resides in a muzzle portion 224 of the barrel 200.

According to Gardner, Jr., the short choke 204 is a removable sleeve. The preferred length $L_C$ of the choke bore is 0.5 inches but may range to as much as three inches. Chokes longer than four inches are strongly discouraged in Gardner, Jr. because it was believed that longer chokes increase drag and thus reduce the overall length of the paintball trajectory. The choke includes a chamfer at each end to gradually transition between the firing chamber of the paintball gun 100 and the first stage and also between the first stage and the second stage. Threads 240, or other attachment mechanisms as described in Gardner, Jr., are provided to affix the barrel 200 to the breech 112 of the gun 100.

Figure 3A:
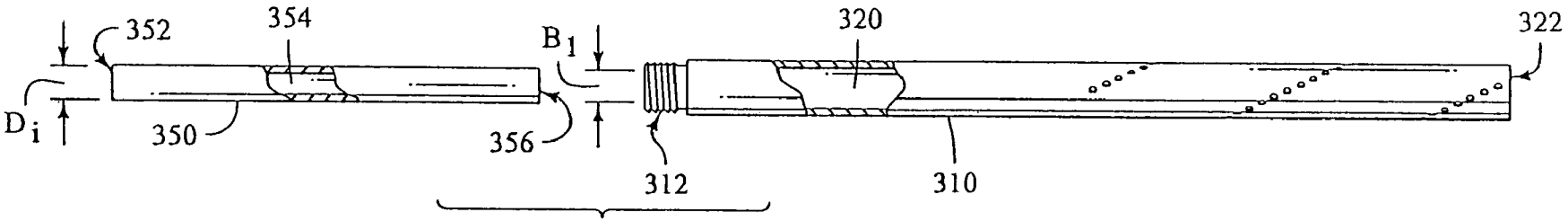
FIG. 3A is an exploded side view of a barrel assembly according to a first embodiment of the present invention, showing the various components thereof.
Figure 3B:
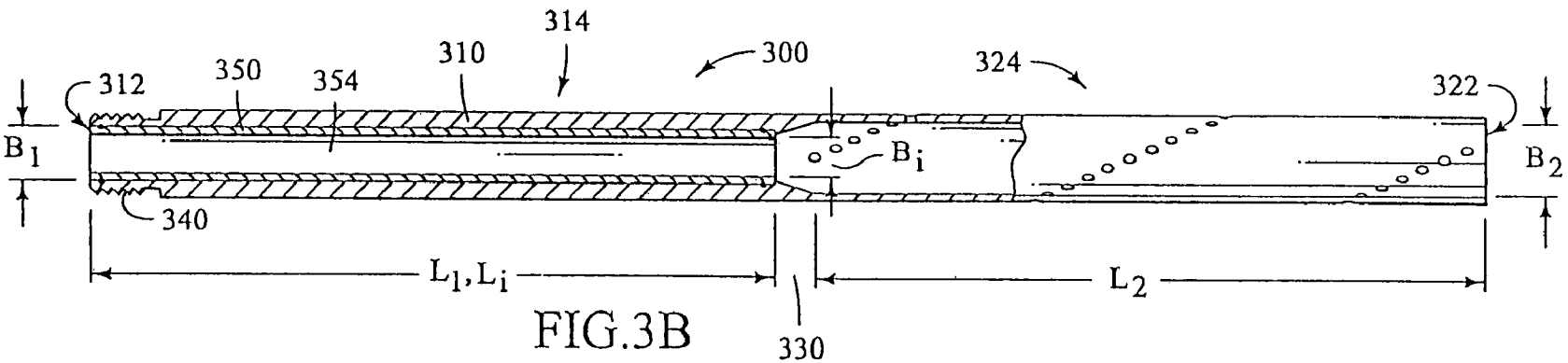
FIG. 3B is a cross-sectional side view the barrel assembly of FIG. 3A, showing the components thereof arranged in their operating relationship.

FIGS. 3A and 3B show a barrel assembly system 300 according to a first embodiment of the of the present invention. Referring to FIGS. 3A and 3B, the barrel assembly system 300 of the first embodiment comprises a barrel body 310 and a barrel insert 350. The barrel body 310 can be attached to the breech 112 of a paintball gun via threads 340 on its breech end 314, or using any one of numerous other types of attachment methods, as desired. The barrel body 310 is a cylindrical tube with a breech end 312 and a muzzle end 322. A barrel bore 320 extends internally through the barrel body 310 along its longitudinal axis from the breech end 312 to the muzzle end 322.

The barrel bore 320 is divided into two primary sections, a breech portion 314 and a muzzle portion 324. The breech portion 314 of the barrel bore 320 has a first bore diameter $B_1$ and extends from the breech end 312 of the barrel body 310 toward the muzzle end 322 for a distance $L_1$. The muzzle portion 324 has a second bore diameter $B_2$ and extends from the muzzle end 322 of the barrel body 310 toward the breech end 312 for a distance $L_1$. The diameter $B_1$ of the breech portion 314 of the barrel bore 320 is sized to receivingly engage the barrel insert 350. Most preferably, the bore diameter $B_1$ is just larger than an outer diameter $D_i$ of the barrel insert 350. The barrel insert 350 can be provided of any length $L_i$, but is preferably at least half the length $L_1$ of the breech portion 314 of the barrel body 310. Most preferably, the length $L_i$ of the barrel insert 350 is approximately equal to the length $L_1$ of the breech portion 314 of the barrel. A transitional bore area 330 can also be included to provide a smooth transition between the breech portion 314 and the muzzle portion 324 of the barrel bore 320.

Figure 4A:
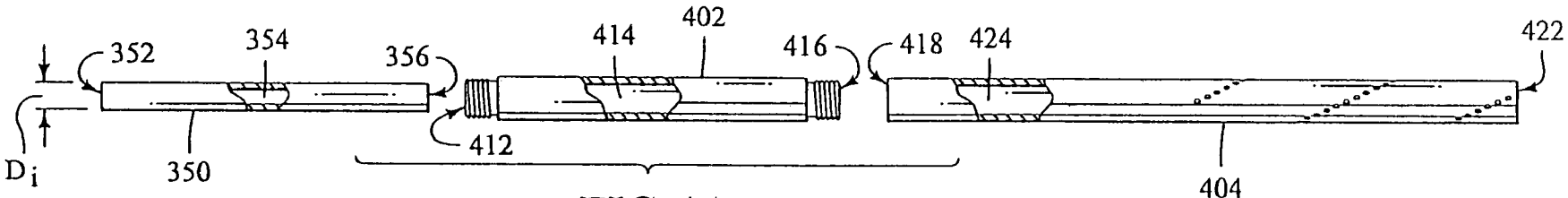
FIG. 4A is an exploded side view of a barrel assembly according to a second embodiment of the present invention, showing the various components thereof.
Figure 4B:
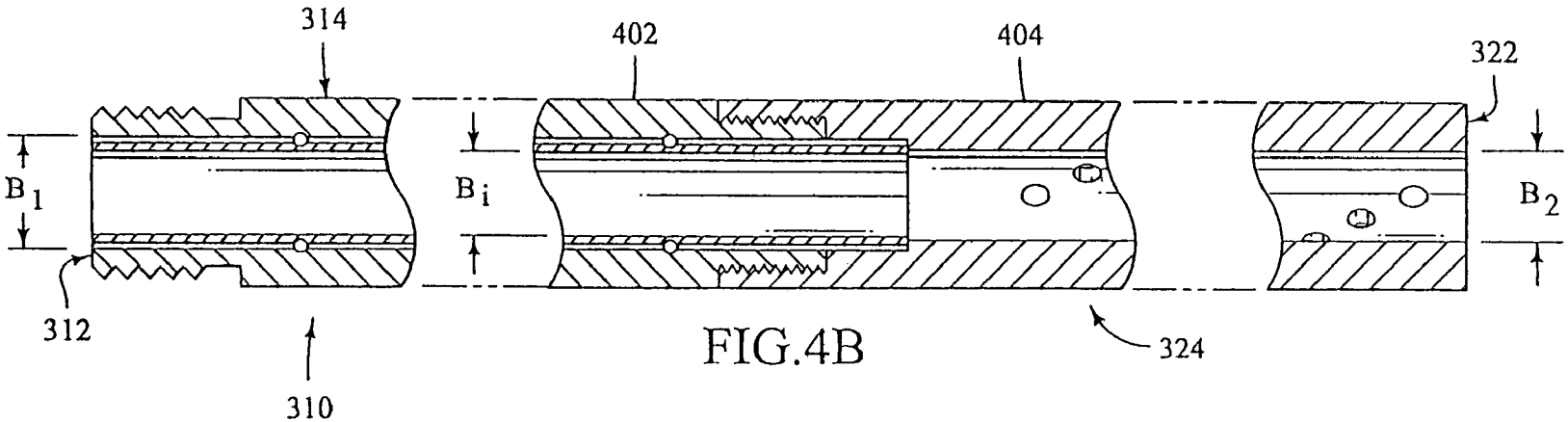
FIG. 4B is a cross-sectional side view of the barrel assembly of FIG. 4A, showing the components thereof assembled in their operating relationship.
Figure 4C:
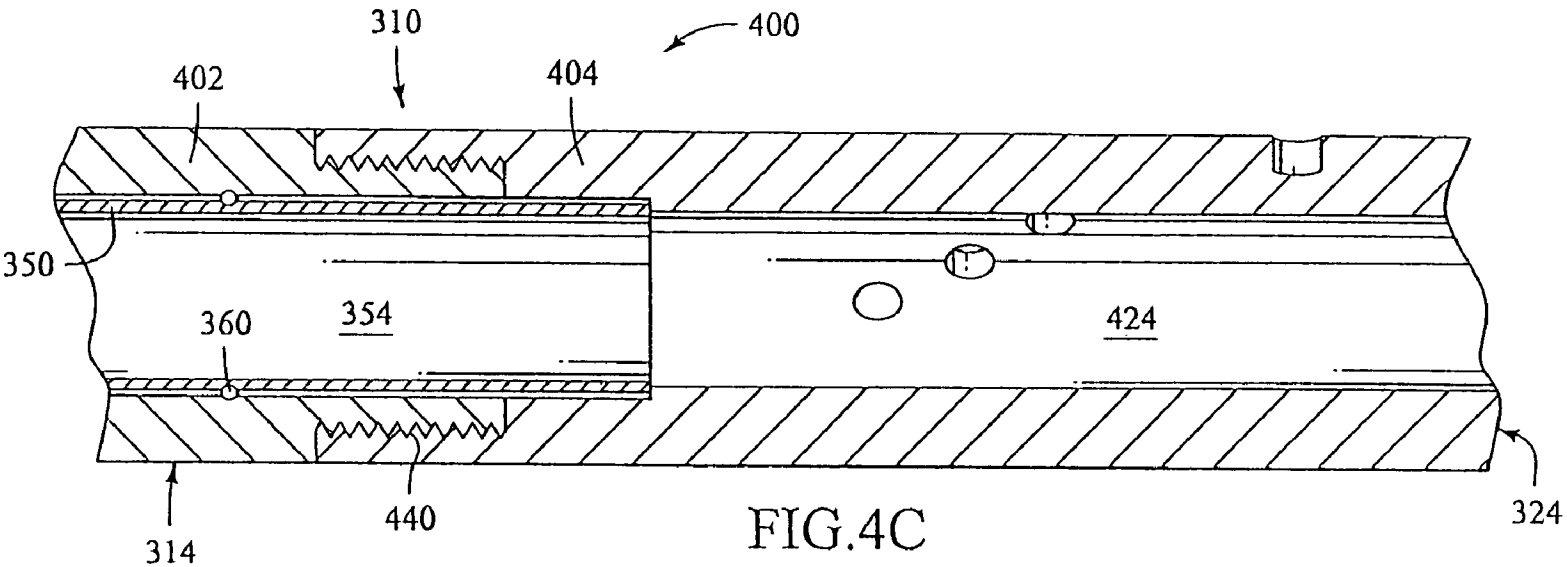
FIG. 4C is an enlarged cross-sectional view of the barrel assembly of FIG. 4B, showing an interface between a barrel front, a barrel back, and a barrel insert.

FIGS. 4A-4C show a barrel assembly 400 according to a second preferred embodiment of the present invention. Similar to the first embodiment, the barrel assembly system 400 of this embodiment comprises a barrel body 310 and a barrel insert 350. Unlike the first embodiment, however, the barrel body 310 of the second embodiment is provided in two separate pieces, including a barrel back 402 and a barrel front 404, which are removably connected together.

The barrel back 402 is a cylindrical tube having a breech end 412, a connection end 416, and a bore 414 extending through the barrel back from the breech end 412 to the connection end 416. The barrel front 404 is also a cylindrical tube having a connection end 418, a muzzle end 422, and a bore 424. The barrel back 402 and the barrel front 404 are connected together at their connection ends 416, 418 either by threaded engagement or by any other suitable method of attachment. The bore 414 of the barrel back 402 and bore 424 of the barrel front 404 communicate to provide the barrel bore 320. The breech end 412 of the barrel back 402 provides the breech end 312 of the barrel body 310 and is attached to the breech 112 of a paintball gun 100 (see FIG. 1).

In this manner, the barrel back 402 forms the breech portion 314 of the barrel body 310, while the barrel front 404 forms the muzzle portion 324. The barrel insert 350 is inserted into the bore 414 of the barrel back 402. Although the barrel insert 350 can be of any length, the barrel insert preferably extends through at least half of the barrel back 402 and most preferably extends through the entire bore 414 of the barrel back 402 and is at least partially received within the bore 424 of the barrel front 404.

Figure 4D:
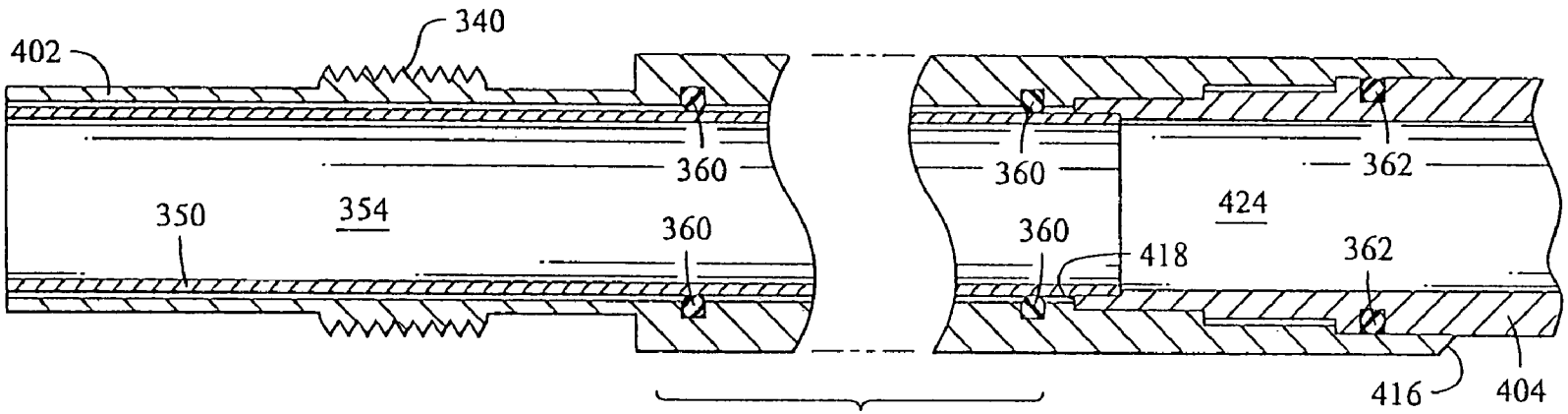
FIG. 4D is a cross-sectional view of a barrel assembly according to yet another embodiment of the invention, showing another potential interface between the barrel front, the barrel back, and the barrel insert.

FIG. 4D illustrates another preferred embodiment of the present invention, showing a cross-sectional view of another method of attachment between the barrel front 404 and the barrel back 402. Referring to FIG. 4D, the attachment end 418 of the barrel front 404 is received into the attachment end 416 of the barrel back 402 and is secured by threaded engagement or some other attachment method, such as twist-lock engagement. O-rings 362 provide a good seal between the barrel back 402 and the barrel front 404 to prevent the unwanted escape of gas through the connection between the barrel sections.

Referring now to FIGS. 3A, 3B, and 4A-4D, in each of these preferred embodiments, the barrel insert 350 preferably comprises a thin-wailed cylindrical tube having a breech end 352, a distal end 356, and a bore 354 that extends longitudinally through the barrel insert 350 from the breech end 352 to the distal end 356. The outer diameter $D_i$ of the barrel insert 350 is sized so that the barrel insert 350 can be slidingly inserted into and retained within the breech portion 314 of the barrel bore 320 through the breech end 312 of the barrel body 310. The outer diameter $D_i$ of the barrel insert 350 is therefore preferably just slightly smaller than the first bore diameter $B_1$. When inserted into the barrel bore, the barrel insert 350 resides primarily within the breech region 314 of the barrel body 310.

The bore 354 of the barrel insert 350 has a diameter $B_i$ and provides a first stage of the barrel assembly that receives a paintball from the paintball gun and stabilizes the initial paintball trajectory. The diameter $B_i$ of the bore 354 of the barrel insert 350 is preferably selected to provide a close-fitting relationship with a paintball to be launched therethrough. Ideally, the bore diameter $B_i$ should be selected such that a paintball positioned within the barrel insert 350 will not fall out of the barrel unassisted but can still be easily pushed through the bore by a light puff of air.

When the paintball gun is fired, the paintball enters the bore of the barrel insert 350 at the breech end 312 of the barrel body 310. The close-fitting barrel insert 350 maintains-the flow of compressed gas directly behind the paintball to enable the energy from the compressed gas to be efficiently transferred to the paintball. In this way, the force imparted by the compressed gas to the paintball accelerates the paintball through the bore 354 of the barrel-insert 350 toward the muzzle portion 324 of the barrel 300.

In its most preferred form, the wall of the interchangeable barrel insert 350 is capable of lateral deformation. The barrel insert 350 of this embodiment is preferably provided with an outer wall of sufficient flexibility to permit it to flex laterally in response to the passage of a paintball or the column of gas propelling the paintball through the bore 354. The bore 354 thereby conforms, at least to some decree, to the shape of the paintball and the flow of the gas column traveling through it during firing of the gun.

A relatively thin wall structure, for example, can endow the barrel insert 350 with this lateral flexibility, permitting its cross-sectional area and shape to more closely and dynamically match those of the paintball fired through it. Accordingly, the barrel insert 350 can be constructed of a metal or synthetic material having a wall thickness of an appropriate thickness, such as approximately between 0.025-0.075 inches, to provide it with sufficient flexibility. The strength and durability of the material should also be taken into consideration. Most preferably, the barrel insert is constructed of aluminum and has a wall thickness of between 0.45-0.61 inches.

The barrel insert 350 is also preferably retained within the barrel body 310 so as to permit the wall of the barrel insert 350 to flex in response to the passage of to a paintball and column of decompressing gas therethrough. In the preferred embodiments, O-rings 360 are provided within grooves formed in a wall of the barrel bore 320. The O-rings 360 removably retain the barrel insert 350 in place within the barrel body 310 through frictional engagement. The O-rings 360 are themselves flexible to permit lateral flexing of the barrel insert 350. In this manner, the barrel insert 350 is securely retained within the barrel body 310 without significantly impinging on the barrel insert's lateral flexibility and while still permitting easy insertion and removal of the barrel insert 350 into and from the barrel bore 320.

Because the barrel insert 350 according to the preferred embodiments is capable of changing cross-sectional area and shape, it permits a closer fit to be maintained between'the paintball and the barrel bore without increased risk of drag or paintball rupture. Although Gardner, Jr. taught that chokes of too great a length would increase drag and reduce gun efficiency, the dynamic reshaping of the barrel insert created by this invention allows the close-fitting barrel insert 350 to extend through a greater length of the barrel bore 320 than previously thought desirable, without sacrificing performance. In its most preferred form, a length $L_i$ of the barrel insert 350 is five inches, which is approximately equal to the length $L_1$ of the breech portion 314 of the barrel 300. Various other lengths $L_i$, however, are within the contemplation of this invention. Preferred lengths range from approximately one-third the length of the breech portion 314 of the barrel bore to slightly longer than the breech portion 314 of the barrel bore.

The muzzle portion 324 of the barrel bore provides a second stage that receives the paintball from the first stage and expels the paintball from the barrel toward the target. A transition stage 330 can optionally be provided between the first stage and the second stage to more smoothly transition between the bore diameter $B_i$ of the first stage and the bore diameter $B_2$ of the second stage. A preferred diameter $B_2$ of the second stage is approximately 0.702 inches. The second stage can include air-rifling, porting, muzzle breaking, and/or other features to provide further advantages. Bores having three or more stages are also within the contemplation of this invention.

As described above, the barrel insert 350 provides an extended acceleration chamber, allowing gas pressure from the paintball gun 100 to be applied directly behind a paintball being fired therefrom over a distance sufficient to permit an efficient transfer of energy from the compressed gas to the paintball. In addition to providing efficient energy transfer between the compressed gas and the paintball, the close-fitting barrel insert 350 also provides a controlled path for the paintball to travel along that substantially prevents wobbling of the paintball within the barrel. Accordingly, by the time the paintball enters the muzzle portion 324 of the barrel 300, the trajectory of the paintball has been stabilized and the paintball-will travel in a more direct course out of the muzzle end 322 of the barrel body 310 toward the target.

Figure 5:
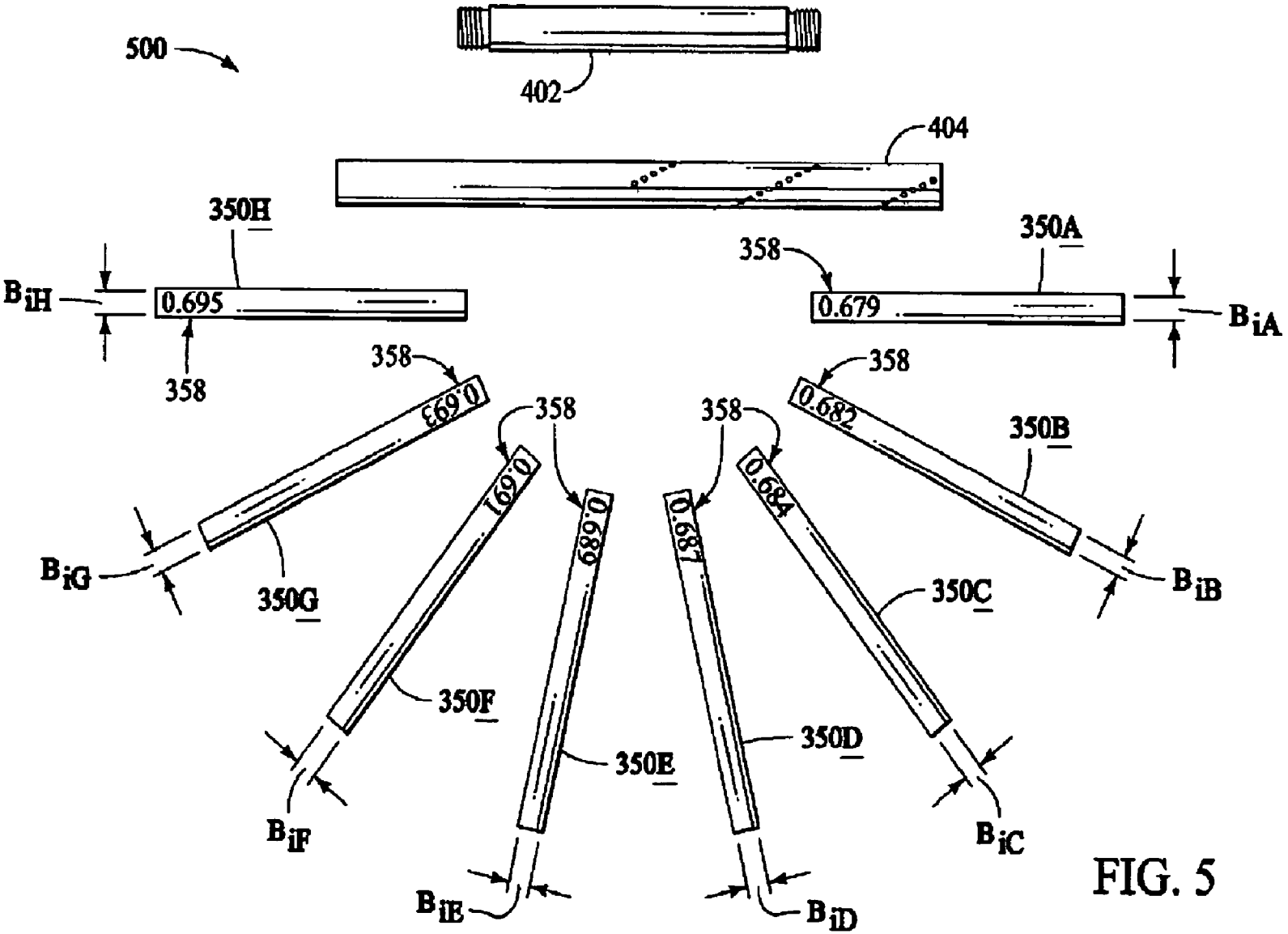
FIG. 5 is a perspective view of a barrel assembly system having a barrel front, a barrel back, and a plurality of barrel inserts according to yet another aspect of the present invention.

FIG. 5 shows a barrel assembly system according to yet another aspect of this invention. Referring to FIG. 5, a barrel assembly system 500 can be provided having a set of barrel inserts 350A-H having a variety of different bore diameters $B_{iA}$-$B_{iH}$. A preferred set of barrel inserts includes eight barrel inserts 350A-H. A first barrel insert 350A has a first insert bore diameter $B_{iA}$ of 0.679 inches. A second barrel insert 350B has a second insert bore diameter $B_{iB}$ of 0.682 inches. Similarly, the third through eighth barrels inserts $B_{iC}$-$B_{iH}$ have third through eighth bore diameters of 0.684 inches, 0.687 inches, 0.689 inches, 0.691 inches, 0.693 inches, and 0.695 inches, respectively.

According to a preferred barrel identification method, the barrel inserts of different bore diameters $B_{iA}$-$B_{iH}$ can be distinguished from each other by engraving numbers 358 indicating the bore size on an outer surface of the barrel insert 350A-H, or by constructing each barrel insert of a distinct color, or both. By way of example, the first through eighth barrel inserts 350A-H having the above range of bore sizes can be given the color coding of silver, turquoise, purple, red, dark blue, green, gold, and plum, respectively. Of course, other barrel insert bore diameters could be provided, and other color coding schemes could be used without departing from the principles and teachings of this invention.

As note previously, paintballs, by virtue of their semi-pliant shell, undergo fluctuations in size and shape in response to changes in ambient atmospheric conditions and due to stresses induced by the compressed gas during firing. The present invention provides a barrel assembly system capable of adapting to these variations in paintball size and/or shape in a way that significantly improves performance. Utilizing a plurality of barrel inserts of various diameters, the gun operator can resize his or her barrel bore simply and quickly by merely replacing the barrel insert to more closely fit various paintball diameters. Because of the ease of replacement of barrel inserts provided by this invention, the adaptation of barrel size can take place in the field without substantial interruption in game play. Also, because of the reduced size and weight of the barrel inserts compared to barrels, the system can be carried by a user without undue discomfort or inhibition of movement.

Figure 6:
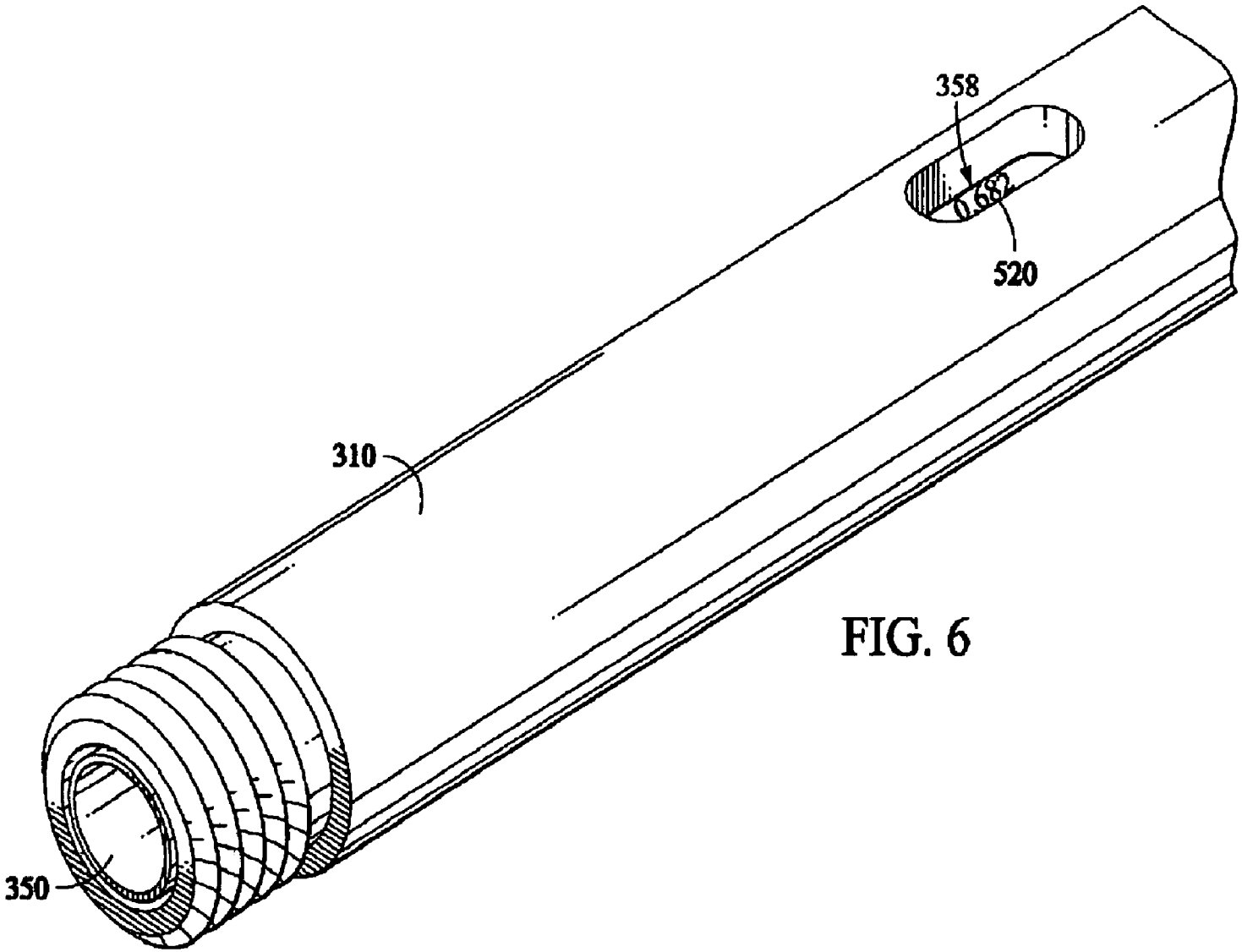
FIG. 6 is a perspective view of a barrel assembly according to a still further aspect of this invention, having a viewing aperture through the barrel body-for determining a size of a barrel insert located within the barrel body.

FIG. 6 is a perspective view showing a barrel assembly illustrating yet another aspect of the present invention. Referring to FIG. 6, in this embodiment, a viewing aperture 520 is provided through the wall of the barrel body 310. As discussed above, the barrel insert 350 can be provided with number 358 on an outside wall thereof that identifies its bore size, with a color indicating its bore size, or both. When positioned within the barrel body 310, the sizing number 358 and/or color of the barrel insert 350 are visible through the viewing aperture 520. In this way, the viewing aperture 520 permits a gun operator to view the barrel insert 350 and thereby identify the size of the insert bore diameter, even while the barrel assembly is fully assembled and fastened to the gun. The viewing aperture 520 can optionally be covered by a clear plastic film or other transparent material to prevent contaminants such as dirt and water from entering the barrel through the aperture 520 while still permitting viewing therethrough.

As is apparent from the foregoing detailed description of the preferred embodiments, the employment of an appropriately configured close-fitting barrel insert 350 of an appropriate length $L_i$ can increase the efficiency of gun operation. Specifically, trapping the propulsive gas more completely behind the paintball as provided by this invention grants several advantages. For instance, compared to a paintball fired by a gull equipped with a barrel of the prior art, a grin equipped with the barrel assembly system of the present invention uses less gas to deploy a paintball with the same initial muzzle velocity. As a result, more shots can be fired using the same size compressed gas reservoir and compressed gas tanks will therefore last longer. Similarly, smaller tanks can also be employed without reducing the number of shots available. Because gas tanks are frequently gun-mounted, by enabling a paintball gun with a smaller gas tank to fire the same number of rounds as guns with a larger tank, the overall gun weight can be lightened. A lighter gun provides the participant with greater gun control.

A paintball game participant must also frequently carry additional ammunition and other accessories onto the field. Because the barrel insert according to the present invention is much smaller and lighter than full-length barrels, carrying spare barrel inserts is much less burdensome than carrying spare gun barrels. Without sacrificing adaptability, a participant can thereby move about more freely, improving game performance, when equipped with a barrel assembly system according to this invention.

Having described and illustrated the principles of the invention in several preferred embodiments thereof, it should be apparent that the invention can be modified in arrangement and detail without departing from such principles. We claim all modifications and variations coming within the spirit and scope of the following claims.

What is claimed is:

1. A barrel system for a painthall gun, comprising:

a barrel body comprising a breech portion and a muzzle portion, said breech portion having threads that removably engage a breech end of a paintball gun and further having a first bore diameter, and said muzzle portion having a second bore diameter, wherein the first bore diameter is larger than the second bore diameter to removably receive a barrel insert therein; and a plurality of barrel inserts each configured to be arranged primarily within the first bore diameter of the breech portion of the barrel body, wherein each barrel insert has an insert bore having a diameter sized to accommodate a paintball therein and permit the paintball to travel therethrough, and wherein each bore diameter is different in size from diameters of one or more of the insert bores of the other barrel inserts, and wherein each barrel insert comprises size indicia to indicate a size of the insert bore.

2. A barrel system according to claim 1, wherein one or more of the diameters of the insert bores of the plurality of barrel inserts is sized between approximately 0.679 inches and 0.692 inches.

3. A barrel system according to claim 1, wherein the barrel body further comprises a barrel back and a separate barrel front that is removably engageable with the barrel back, said barrel back comprising threads that are removably connectable to a paintball gun.

4. A barrel system according to claim 1, wherein each of the barrel inserts comprises a flexible wall.

5. A barrel system according to claim 1, wherein each of the barrel inserts comprises a wall thickness of between about 0.025 to 0.075 inches.

6. A barrel system according to claim 1, wherein the barrel system provides a two-stage barrel assembly including a first stage having a first internal diameter defined by the barrel insert bore and a second stage having a second internal diameter that is larger than the first internal diameter.

7. A barrel system according to claim 6, wherein the first internal diameter is sized and configured to receive a paintball in a close-fitting relationship.

8. A barrel system according to claim 7, wherein the first internal diameter ranges between approximately 0.679 inches to about 0.695 inches.

9. A barrel system according to claim 1, wherein said barrel body further comprises:

a barrel back comprising the breech section, wherein the barrel back is removably attachable to a paintball gun; and a barrel front comprising the muzzle section, wherein the barrel front is removably attachable to the barrel back.

10. A barrel system for a paintball gun comprising:

a barrel body comprising a barrel back and a separate barrel front that is removably engageable with the barrel back, said barrel back comprising threads being removably connectable to a paintball gun;

a plurality of barrel inserts, each barrel insert comprising an internal bore that is different in diameter from one or more of the other barrel inserts;

wherein each of the barrel inserts comprises a size indicia visible on an external portion of the barrel insert; and wherein each of the barrel inserts is configured to be substantially arranged within an enlarged bore of a breech section of the barrel back.

11. A barrel system according to claim 10, wherein the size indicia comprises a color coding corresponding to the diameter of the internal bore.

12. A barrel system according to claim 10, wherein each of the barrel inserts comprises a flexible thin wall.

13. A barrel system according to claim 10, wherein each of the barrel inserts comprises a wall having a thickness of between approximately 0.025 to 0.075 inches.

14. A barrel system for a paintball gun comprising:

a barrel body comprising a barrel back and a separate barrel front that is removably engageable with the barrel back, said barrel back comprising threads that are removably connectable to a paintball gun;

a barrel insert comprising an internal bore having a diameter sized to receive a paintball;

a size indicia on the barrel insert, wherein the size indicia indicates a size of the internal bore diameter; and wherein the barrel insert is configured to be substantially arranged within an enlarged bore of a breech section of the barrel back, and wherein the barrel front comprises a bore that has a smaller diameter than the enlarged bore of the barrel back.

15. A barrel system according to claim 14, wherein the barrel system comprises a plurality of barrel inserts, and wherein each barrel insert comprises an internal bore having a diameter different from the diameter of one or more of the other barrel inserts.

16. A barrel system according to claim 15, wherein the size indicia comprises a number corresponding to the diameter of the internal bore.

17. A barrel system according to claim 15, wherein the barrel insert comprises a thin wall having a thickness of between approximately 0.025 to 0.075 inches.

18. A barrel system according to claim 14, wherein the barrel body cannot operate to effectively transport a paintball through the barrel body at a desired velocity without a barrel insert due to the enlarged bore of the breech section and the smaller diameter bore of the barrel front.

19. A barrel system according to claim 14, wherein the barrel insert comprises a flexible wall.

* * * * *